US005130955A

United States Patent [19]

Luerker et al.

[11] Patent Number: 5,130,955

[45] Date of Patent: Jul. 14, 1992

[54] ATHLETIC TIMER CORRECTION SYSTEM

[76] Inventors: Dean Luerker, 909 Towne Lake Dr., Longview, Tex. 75601; David E. Mitchell, Box 131C, R.R. 2, Poseyville, Ind. 47633

[21] Appl. No.: 722,208

[22] Filed: Jun. 27, 1991

Related U.S. Application Data

[63] Continuation-in-part of Ser. No. 625,902, Dec. 11, 1990.

[51] Int. Cl.[5] ..... G04F 10/04; G04F 7/10; G04B 19/00

[52] U.S. Cl. ..... 368/3; 368/113; 368/10; 368/89; 364/569; 377/20; 377/24.2; 377/5; 377/112; 434/254

[58] Field of Search ..... 368/1, 2, 3, 9, 10, 368/107, 110, 111, 112, 113, 89; 364/569; 377/20, 24.2, 5, 112; 434/254

[56] References Cited

U.S. PATENT DOCUMENTS

| | | | |
|---|---|---|---|
| 3,696,610 | 10/1972 | Charbonnier | 368/1 |
| 3,781,529 | 12/1973 | Abramson et al. | 235/92 GA |
| 3,934,123 | 1/1976 | Maurer et al. | 235/92 PD |
| 4,017,794 | 4/1977 | Romrell | 324/78 D |
| 4,180,726 | 12/1979 | DeCrescent | 250/222 R |
| 4,201,041 | 5/1980 | Tanaka | 368/112 |
| 4,245,334 | 1/1981 | Bieramperl | 368/3 |
| 4,356,387 | 10/1982 | Tsubota et al. | 235/92 PK |
| 4,385,227 | 5/1983 | Bridges | 377/20 |
| 4,392,122 | 7/1983 | Hocken | 340/323 R |
| 4,518,266 | 5/1985 | Dawley | 368/10 |
| 4,571,698 | 2/1986 | Armstrong | 364/569 |
| 4,681,118 | 7/1987 | Asai et al. | 128/643 |
| 4,697,278 | 9/1987 | Fleischer | 377/24.1 |
| 4,700,369 | 10/1987 | Siegal et al. | 377/24.2 |
| 4,780,085 | 10/1988 | Malone | 434/254 |
| 4,823,367 | 4/1989 | Kreutzfeld | 377/24.2 |
| 4,857,886 | 8/1989 | Crews | 340/323 |
| 4,901,294 | 2/1990 | Aihara | 368/113 |
| 4,932,045 | 6/1990 | Kasoff et al. | 377/24.2 |
| 4,989,222 | 1/1991 | Lutts et al. | 377/24.1 |
| 5,001,683 | 3/1991 | Fukumoto et al. | 368/113 |

*Primary Examiner*—John S. Heyman
*Attorney, Agent, or Firm*—Baker & Daniels

[57] ABSTRACT

A swim/sporting event timer/counter times a athlete moveing along a predetermined path based on signals received from the athlete. A time counter begins when movement of the athlete is detected. Based upon the amount of time it takes for the athlete to pass by the timing system, the time counter is automatically adjusted, if necessary, to account for the time counter having been started at an incorrect time.

13 Claims, 13 Drawing Sheets

ATHLETIC TIMER CORRECTION SYSTEM

RELATION APPLICATION

This is a continuation-in-part of application Ser. No. 07/625,902 filed 11 Dec. 1990.

FIELD OF THE INVENTION

The present invention relates to sporting event lap counters/timers and, in particular, to sporting event lap counters/timers used by swimmers.

BACKGROUND OF THE INVENTION

It is important for competitive swimmers or other persons travelling laps on predetermined courses to know the time it takes to complete each lap, as well as other statistics such as the total elapsed time, lap number and temperature. Several devices are known in the art for providing some of these statistics.

Two of the most common devices used by swimmers are (1) water-resistant wrist-watches that are self-activated and (2) large electrical clocks that are above the water and are visible to swimmers. The clocks are more generally used in recreational lap swimming and are usually located at the end of a swimming lane. They require a swimmer to raise the swimmer's head above the water level to view the last split time swam by the swimmer, and the time depicted is an approximate time because the clock does not reset at the end of each lap swam. The wrist-watches are not workable for swimmers except for monitoring total elapsed time, because a swimmer must activate the watch after each lap to monitor split times, thereby interrupting swimming activity. As a result, it is very difficult to conveniently view progress during the swim.

One prior lap timer, disclosed in Dawley, U.S. Pat. No. 4,518,266 shows a lap timer having a kick pad which is submerged in water, and readouts that are positioned above the water level. Each time a swimmer completes a lap, the swimmer makes active contact with the kick pad and a lap time is computed. This device has the deficiencies of (a) requiring the swimmer to specifically attempt to touch the kick pad during each lap, and (b) requiring the swimmer to lift the swimmer's head out of the water to view the readouts. As a result, it is very difficult for the swimmer to view progress during the swim.

Other electronic devices for use by swimmers and divers are known. For example, *Charbonnier*, U.S. Pat. No. 3,696,610 discloses an underwater wristwatch containing a timer to indicate the duration of a compression stage to be observed by a diver. However, this patent does not disclose a device for determining elapsed time or the number of laps traversed by a swimmer, nor does it include any digital displays. Siegal, U.S. Pat. No. 4,700,369 and Kasoff, U.S. Pat. No. 4,932,045 also disclose swim lap counters in which the completion of a lap is indicated by a physical switch. The Siegal device, like Dawley, requires that a switch be manually depressed by a swimmer upon completion of each lap. Both of these devices have the shortcoming of requiring the swimmer to consciously locate and depress the switch upon completion of each lap. Kasoff discloses a lap counter that may be worn in the palm of a hand or the bottom of a foot as shown in its FIGS. 4 and 5, and is actuated by the swimmer striking the device against the side of a pool. Although Kasoff does not require that the swimmer contact any particular portion of the pool upon completion of a lap, the swimmer must still consciously contact the side of the pool with sufficient force to actuate the mechanical switch. The Siegal and Kasoff devices include underwater digital displays of lap counts, while the Dawley device includes displays for additional information including split time and elapsed time. However, none of these devices is configured so it may be placed on the bottom of a pool.

Malone, U.S. Pat. No. 4,780,085 discloses a lap timing device that does not detect completion of a lap by a mechanical switch, but rather by an ultrasonic proximity detector positioned at the end of a swimming lane. An ultrasonic wave is normally absorbed by water indicating a swimmer is not positioned in proximity to the timer. However, when the swimmer approaches the counter, ultrasonic waves are reflected back toward the counter to generate a lap completion signal. The device also displays a variety of statistics regarding a training session, including total swim time, average lap time, and minimum and maximum lap times. However, the readouts of the Malone device are not observable by a swimmer looking toward the bottom of a pool, nor are they observable by a swimmer regardless of the direction in the pool lane the swimmer is swimming. Moreover, the proximity detection system does not provide sufficiently accurate results.

Crews, U.S. Pat. No. 4,857,886 discloses a networked racing vehicle timing/location system in which multiple transceivers are positioned at various stages along a race course and also on each race vehicle. Each stationary transceiver transmits a narrow width signal. When the transceiver on a vehicle detects a narrow width signal from a stationary transceiver, the vehicle transceiver transmits a coded signal to the stationary transceiver which identifies the particular vehicle. A remote computer is connected to all stationary transceivers in order to continuously monitor the location of all vehicles. However, in this system, the vehicles must have receivers, and times are not computed by comparing the time it takes for a single transmitted signal to reach two spaced receivers.

Asai, U.S. Pat. No. 4,681,118, discloses a system in which a swimmer may wear a heart monitoring device that transmits signals to generate an electrocardiogram of the swimmer. However, this system does not generate total or split lap times, and multiple swimmers in the same pool using such devices would generate interfering signals.

Finally, none of the above-referenced patents discloses a swimming lap counter/timer that includes a means for storing data regarding swimming sessions and transferring the data to a computer for subsequent analysis.

One object of the invention is to provide a swimmer timer that is waterproof and fully submersible, and which includes an upwardly projecting display so that it may be viewed by a swimmer without the swimmer raising the swimmer's head out of the water.

Another object of the invention is to provide a swimmer timer that does not require a swimmer to make a physical contact with a switch to indicate completion of a lap.

Another object of the invention is to provide a swimmer counter capable of inverting the statistical display so that the display is readable by the swimmer when moving in either direction.

Another object of this invention is to provide an easily transportable swim timing device for use in any swimming facility and to facilitate personal use as an individual training timing device.

Another object of the invention is to provide an timer/counter that can be totally immersed in water and which has a reduced risk of electrical shock.

Another object of the invention is to provide a method for processing signals from an athlete and for automatically correcting lap split times based upon analysis of those signals.

Figure 7:
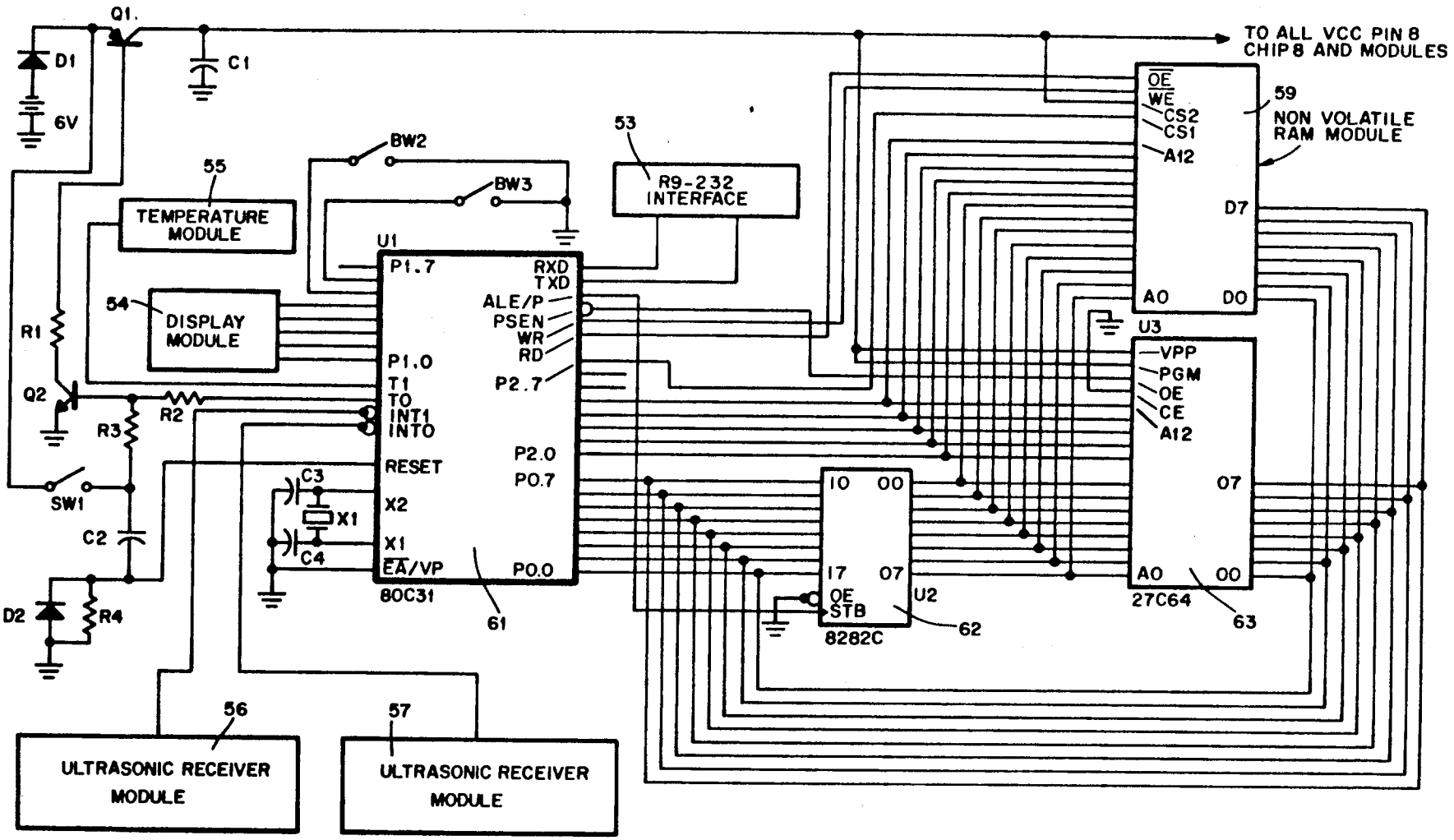
FIG. 7 is a block diagram of a microcontroller based counter/timer in accordance with the present invention.
Figure 7A:
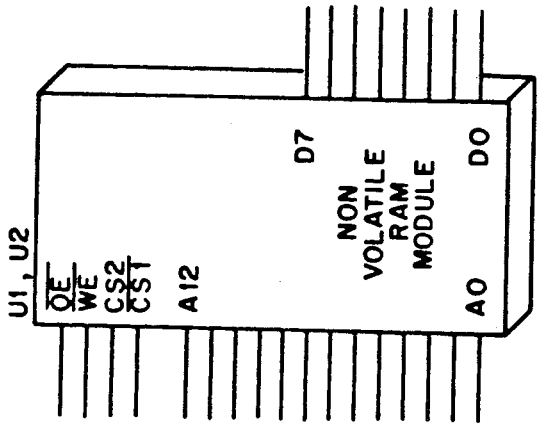
Figure 7B:
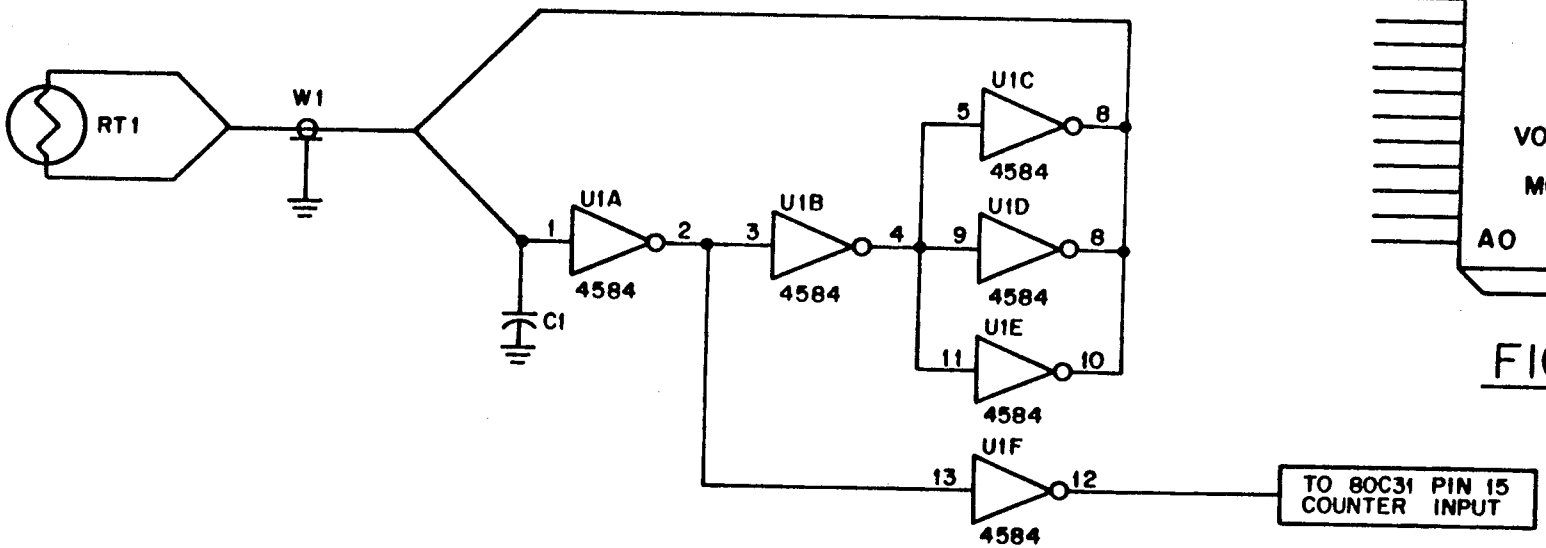
Figure 7C:
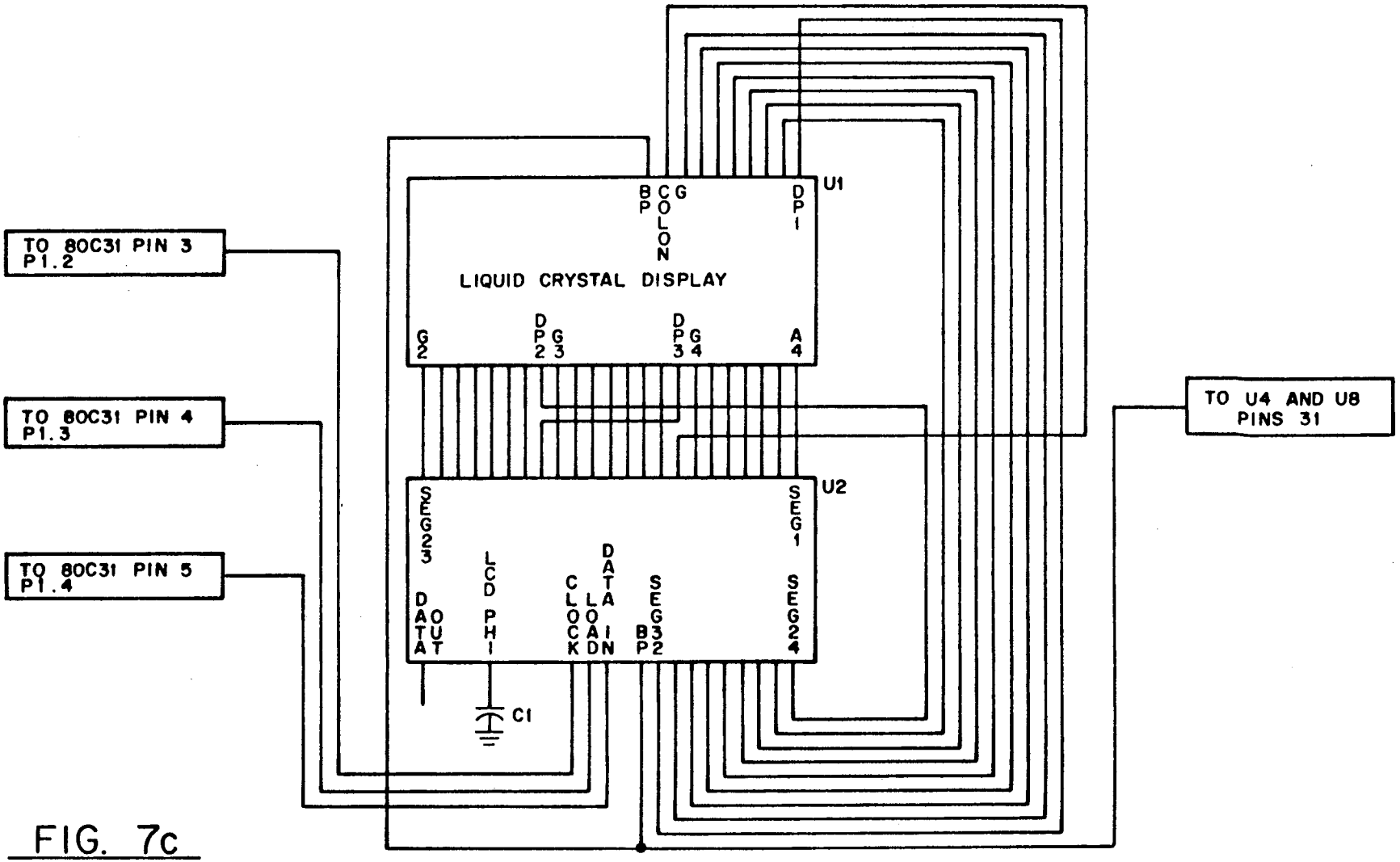
Figure 7D:
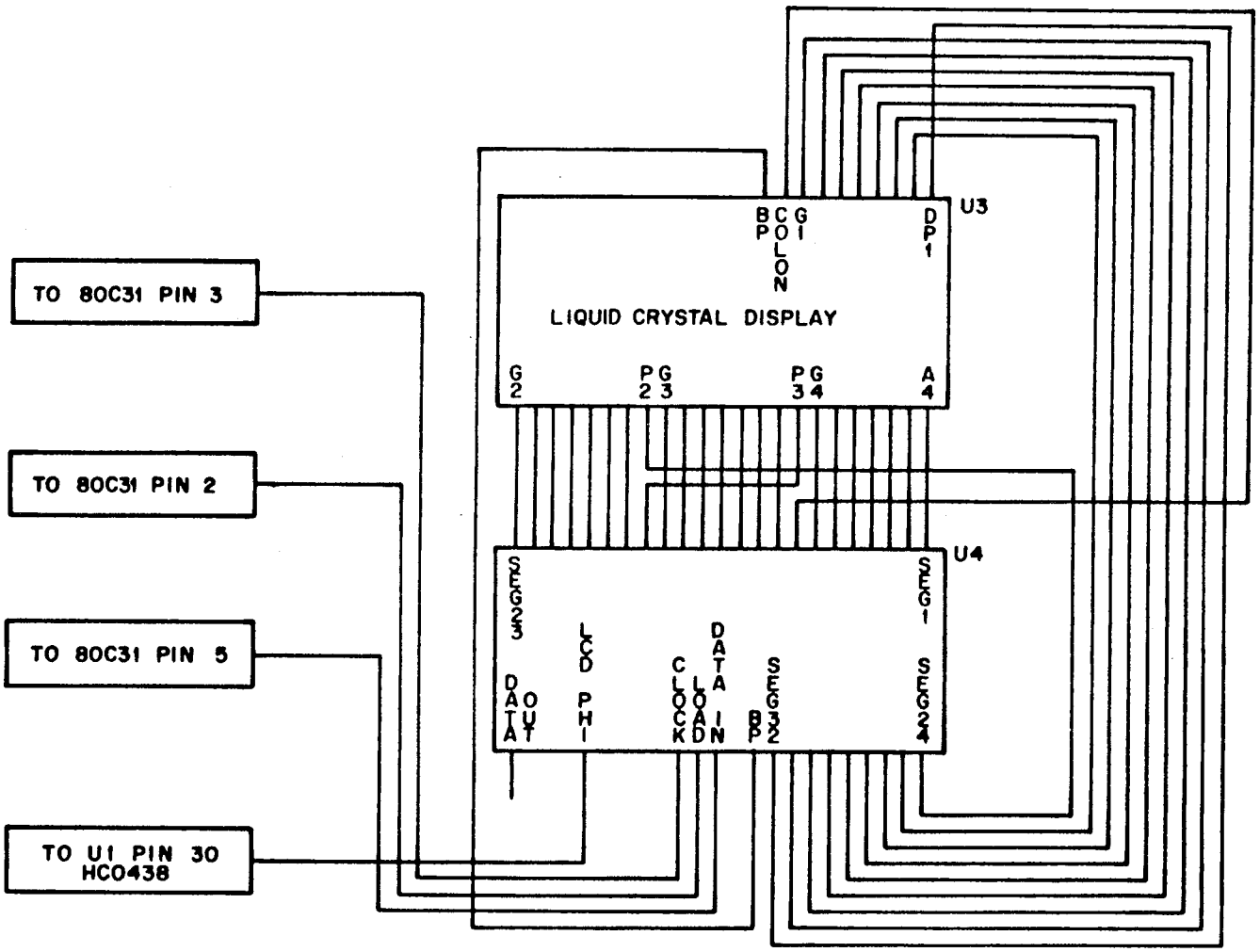
Figure 7E:
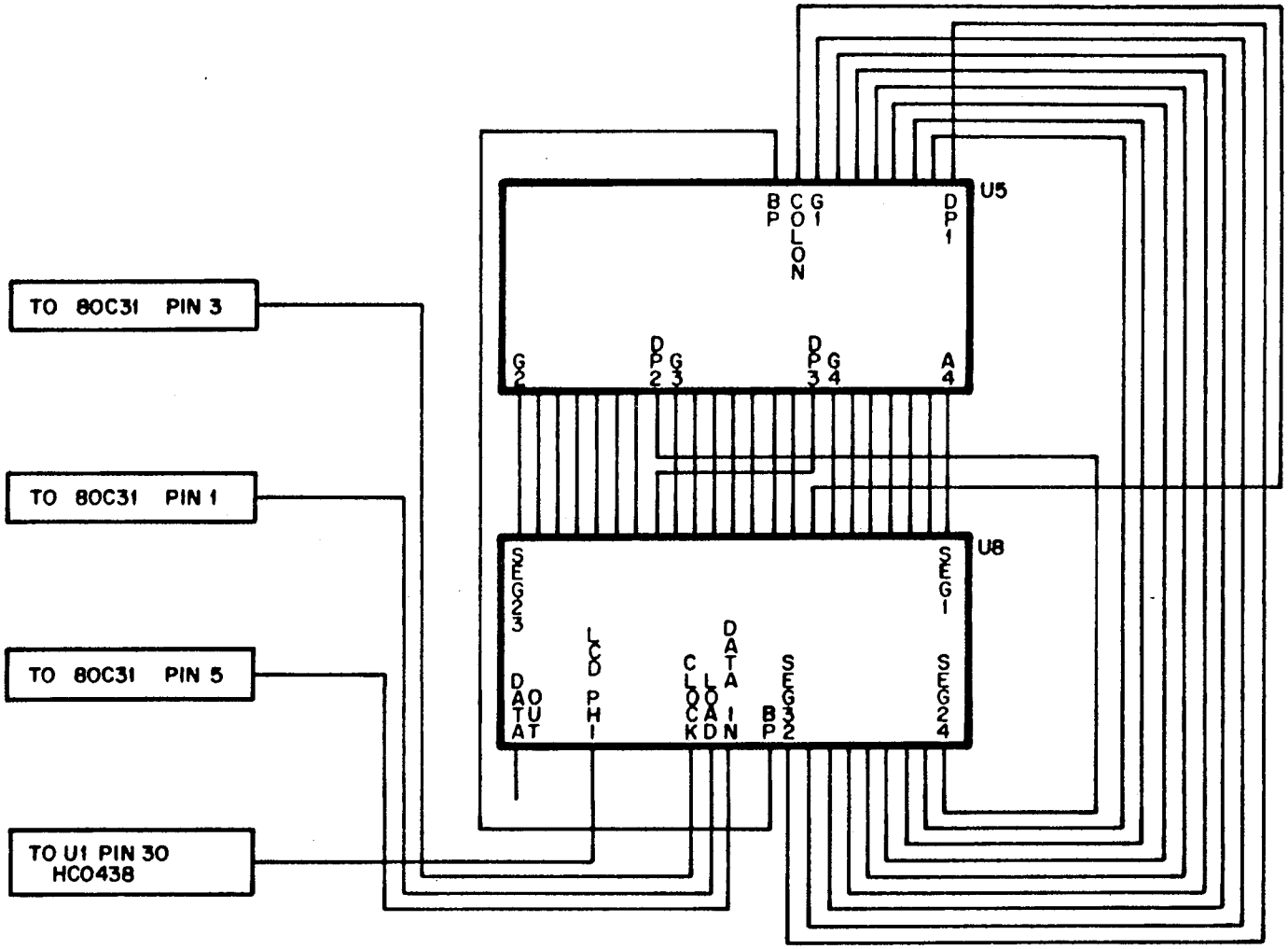
Figure 7E:
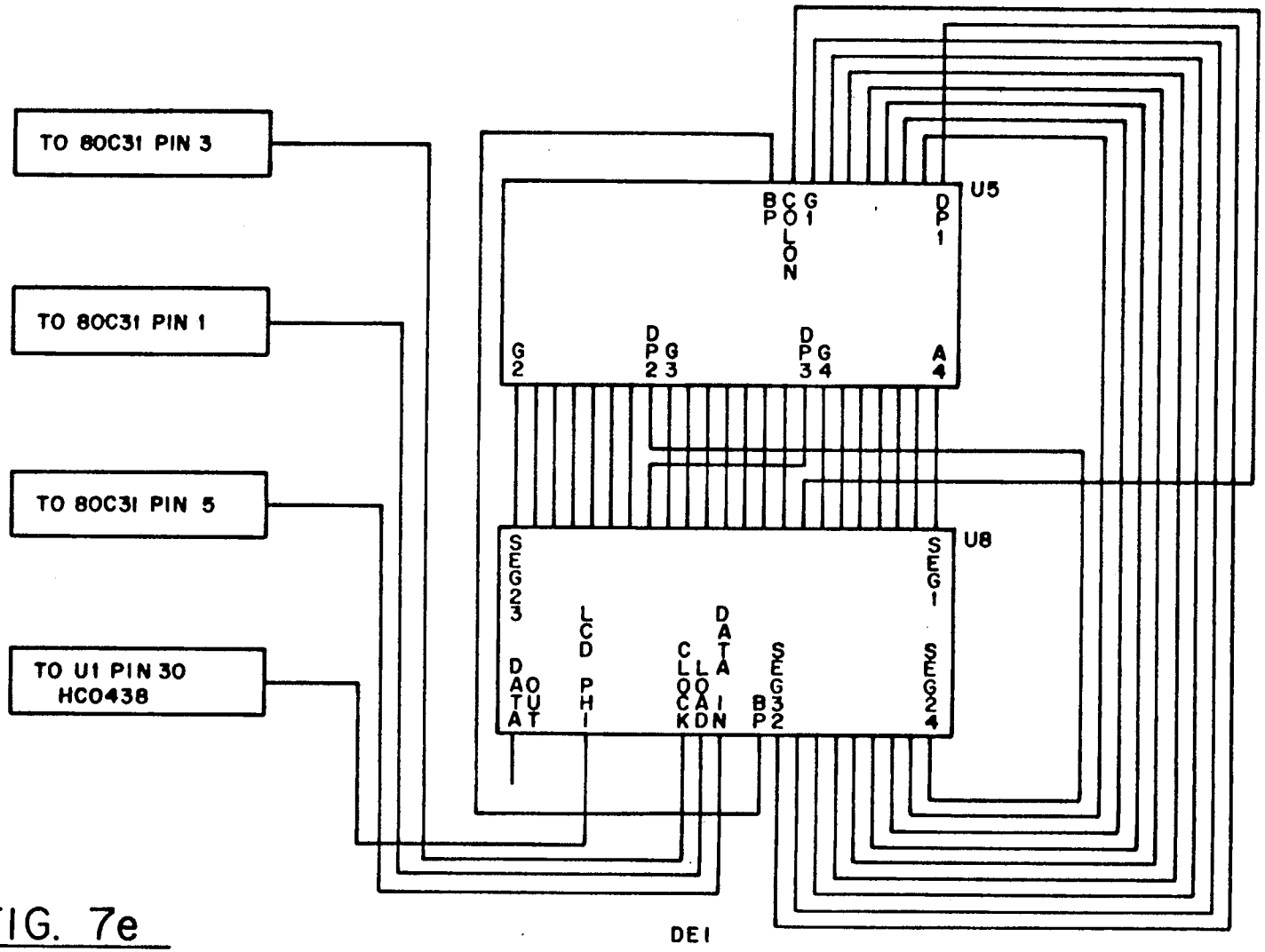
Figure 7F:
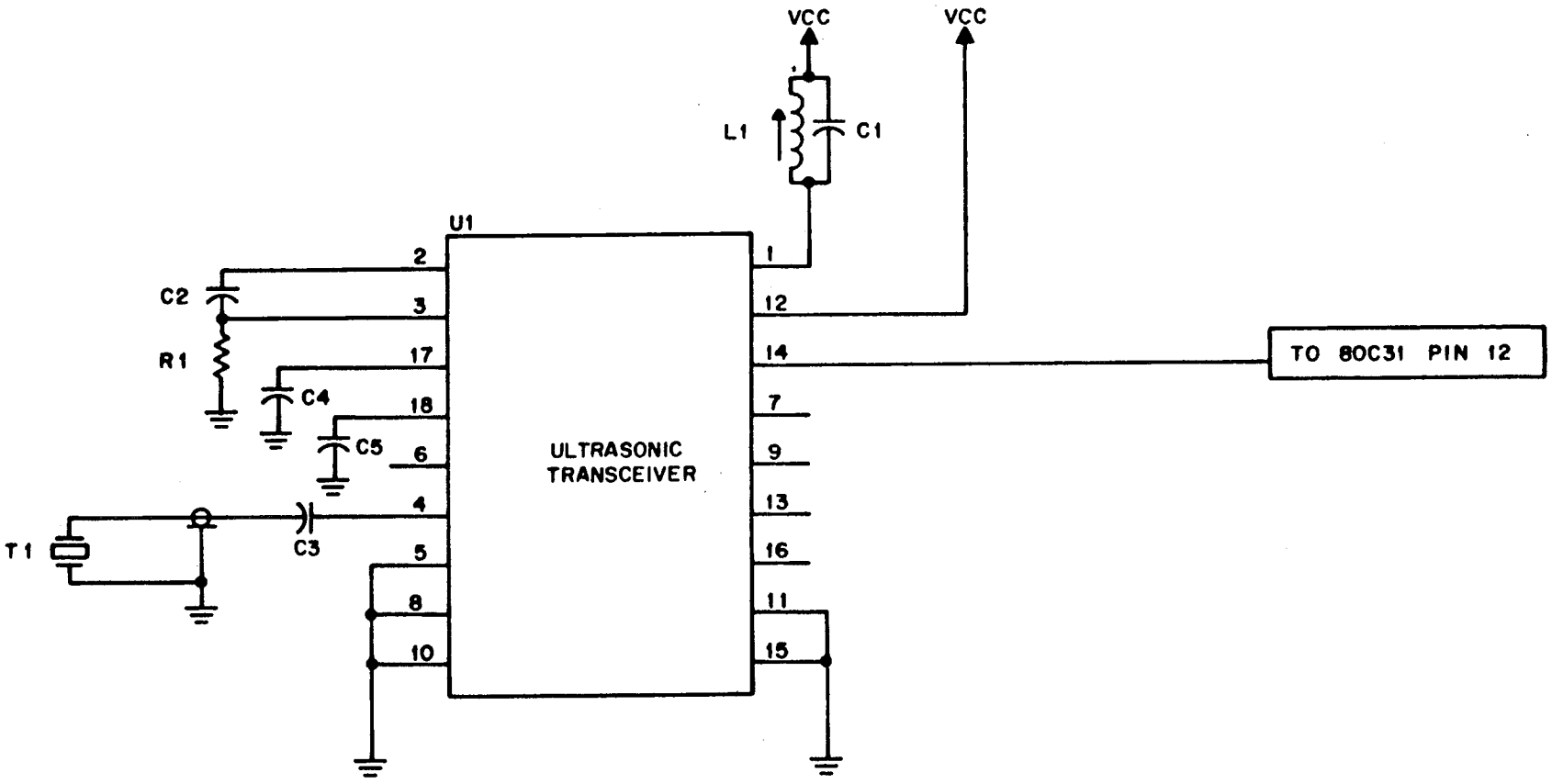
Figure 7G:
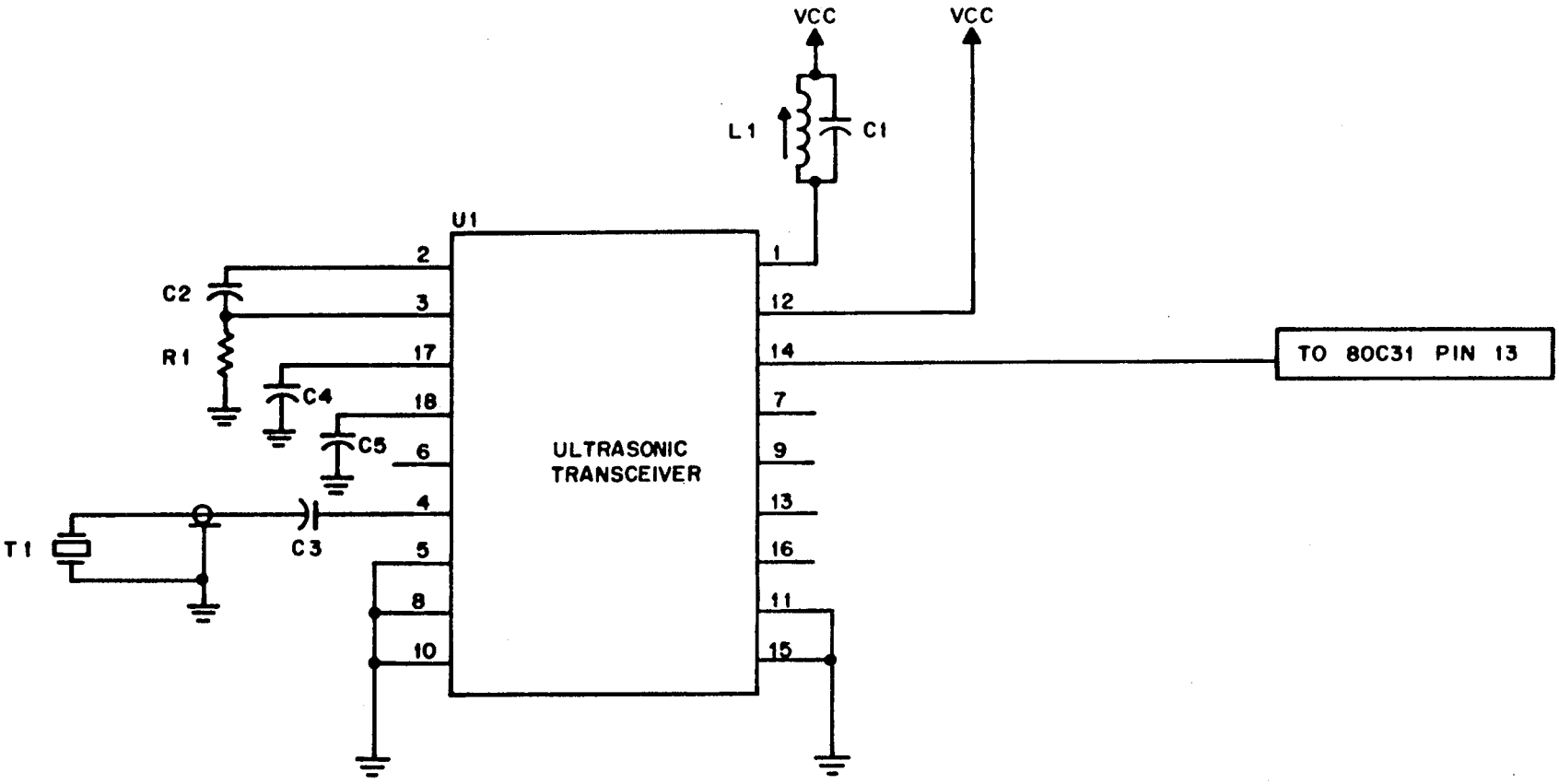
Figure 7H:
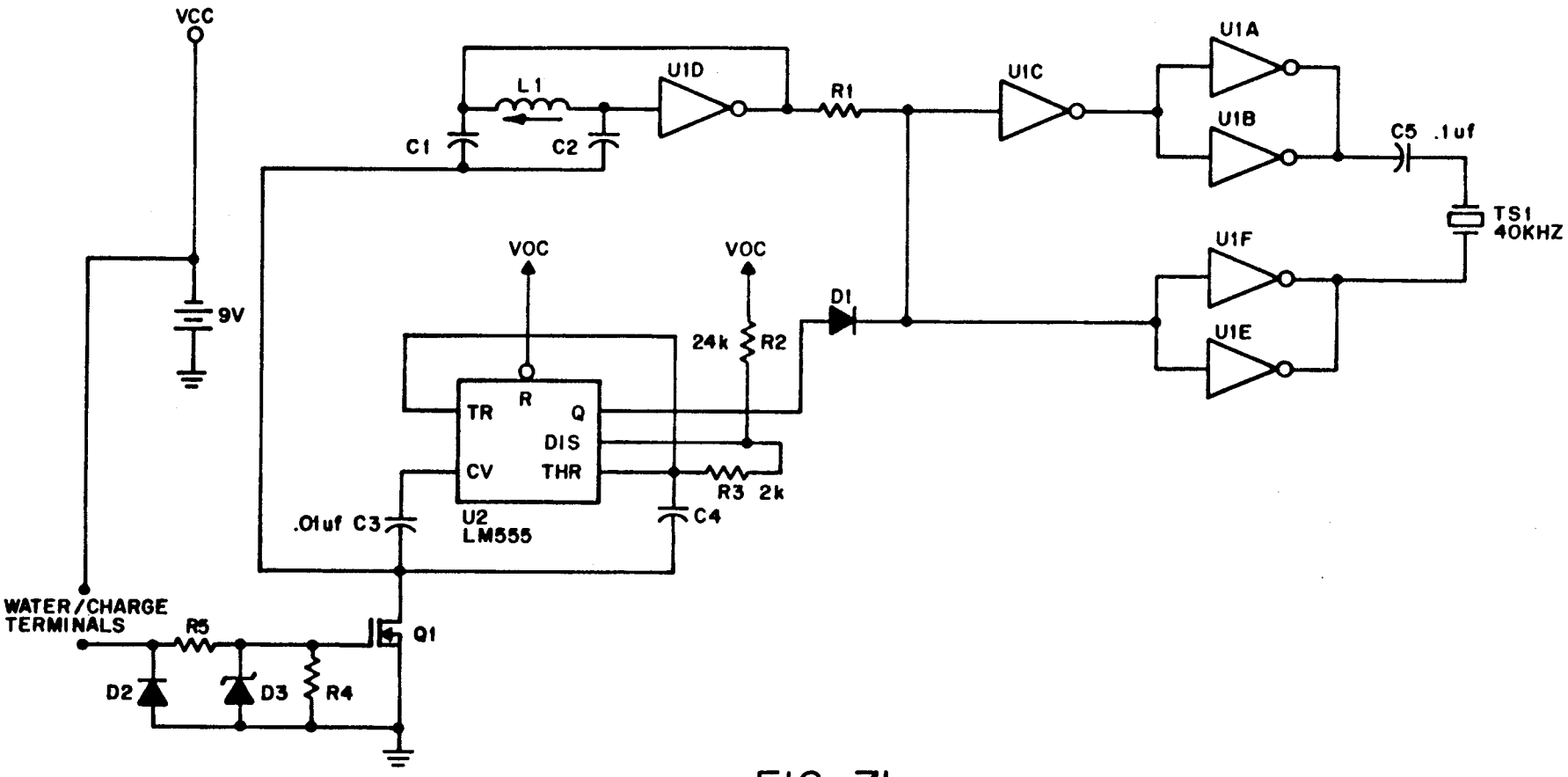

FIGS. *7a–7h* are sub-block diagrams fo the microcontroller based counter timer shown if FIG. 7.

Figure 6:
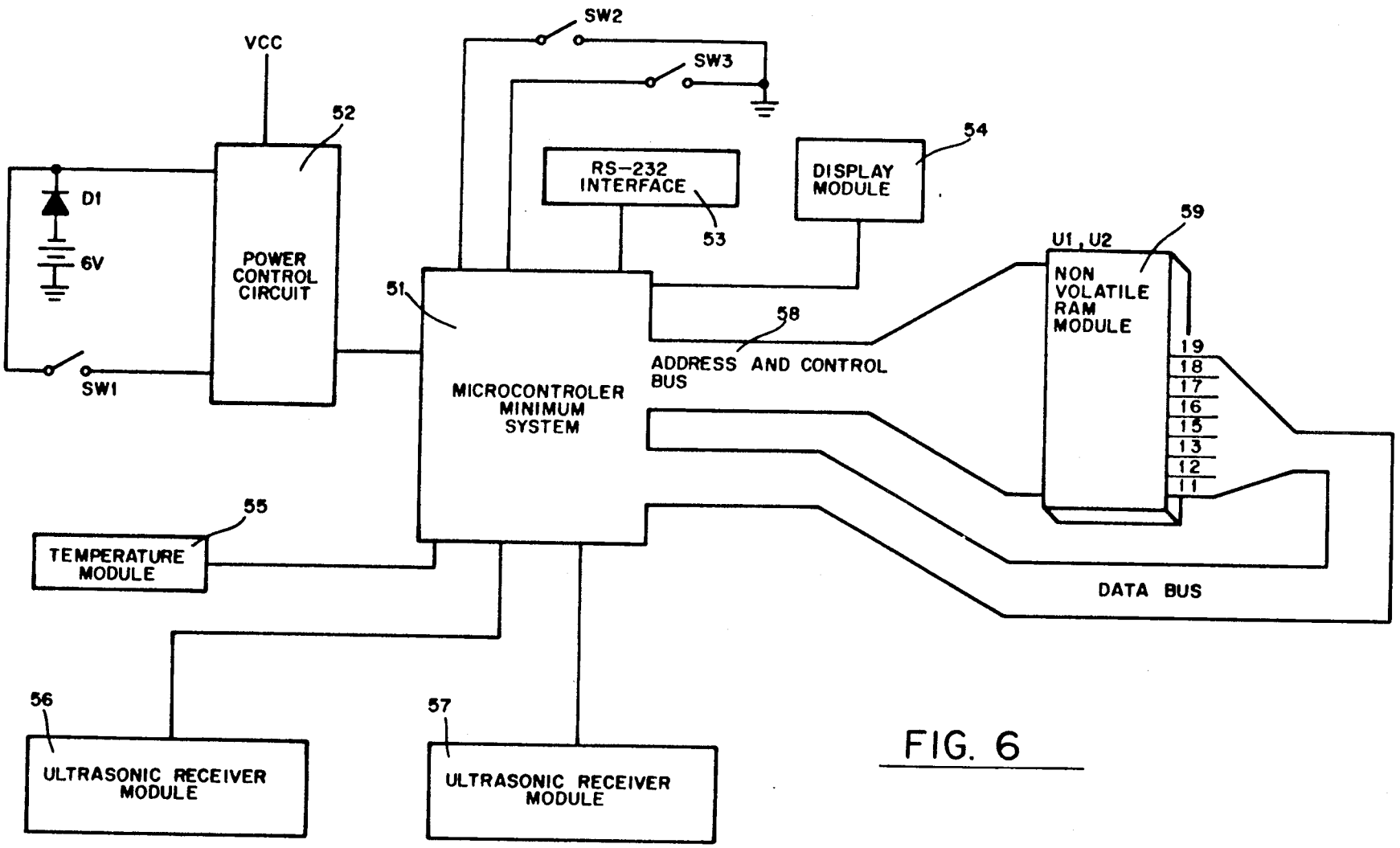
FIG. 6 is a block diagram of electronic circuitry that may be employed in one embodiment of the invention.
Figure 8:
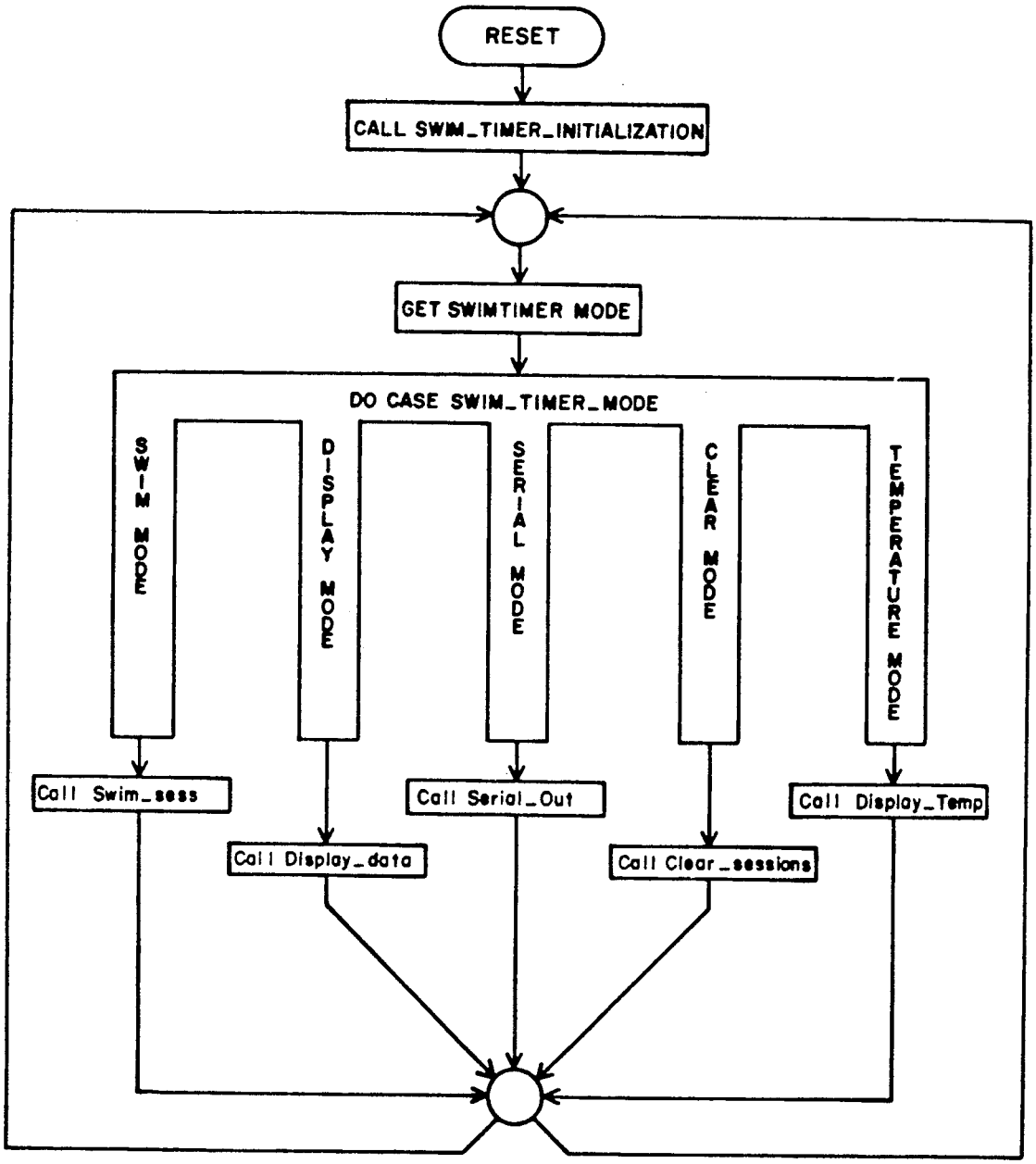

FIG. 8 is a software flow diagram of software that may be used in connection with the circuit shown in FIGS. 6 and 7.

The appendix shows source code written in the PL/M language that may be compiled and loaded in the memory shown in FIG. 6 to operate the hardware disclosed herein.

SUMMARY OF THE INVENTION

One embodiment of the present invention comprises a waterproof housing with three upwardly projecting digital display readouts and two spaced ultrasonic receivers or sensors. A swimmer wears an ultrasonic transmitter tuned to the specific frequency of the ultrasonic receivers in the housing. The housing is place on the bottom of a pool within about ten feet of the end of the starting wall of the swimming lane. By measuring the time differential for the ultrasonic signals from the transmitter to reach the two receivers in the housing, the position of the swimmer (i.e., in front of, directly over, or behind the housing), is determined. The timer begins when the diver first enters the water. The display shows the total time and the elapsed time for a specific lap. In one embodiment, completion of a lap is identified by determining when the transmitted signal changes from being received by the two receivers by an increasing time differential to being received by a decreasing time differential, although a single receiver employing the doppler effect may also be used. Each time the swimmer passes over the housing, the numbers on the display are oriented so that the swimmer may look down into the water and easily view the time regardless of which direction the swimmer is traveling in the lane or other predetermined course.

DETAILED DESCRIPTION

Figure 1:
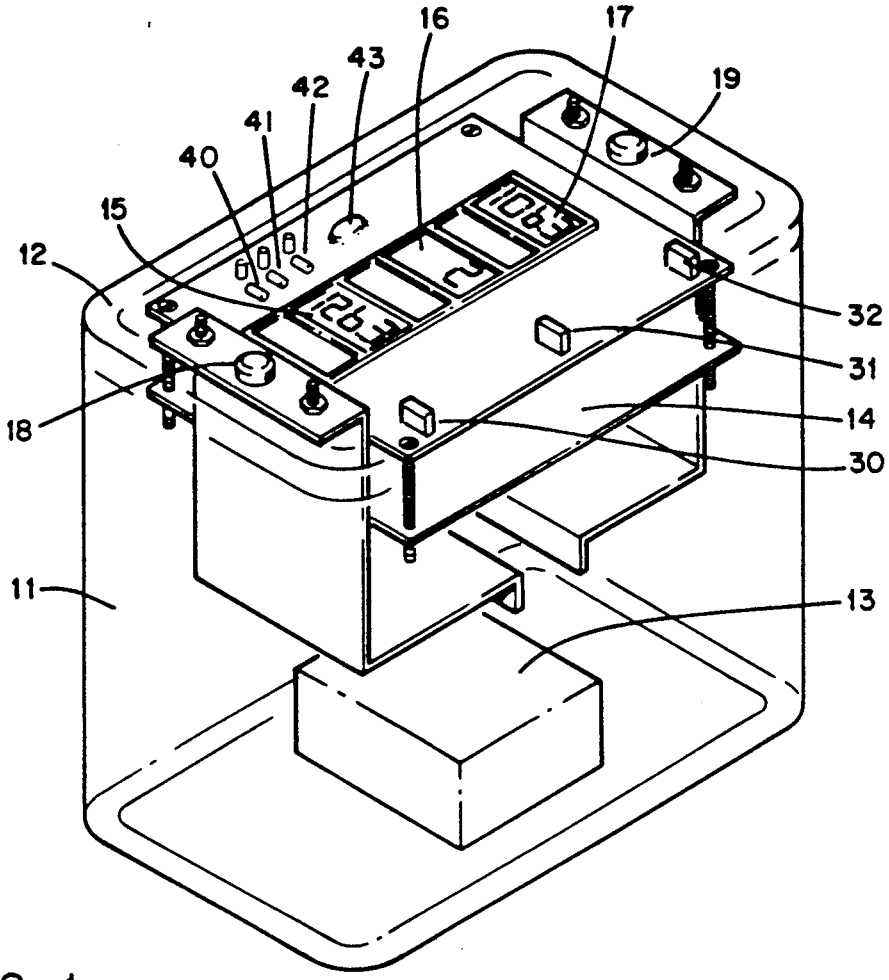
FIG. 1 is a perspective view of one embodiment of a counter/timer of the invention.

As shown in FIG. 1, one embodiment of the invention comprises a translucent, submersible housing 11 that includes a waterproof lid 12 sealed by a gasket (not shown). Housing 11 contains an internal power source such as a rechargable six volt lead acid battery 13 and electronic components 14. On the top of lid 12 are positioned three upwardly projecting seven segment LCD displays 15, 16 and 17 and first and second receivers 18 and 19. Also mounted near the top of lid 12 are water temperature sensor 43 and first, second and third magnetic reed switches 30, 31 and 32, which may be actuated by a magnet passed in proximity thereto.

Figure 2:
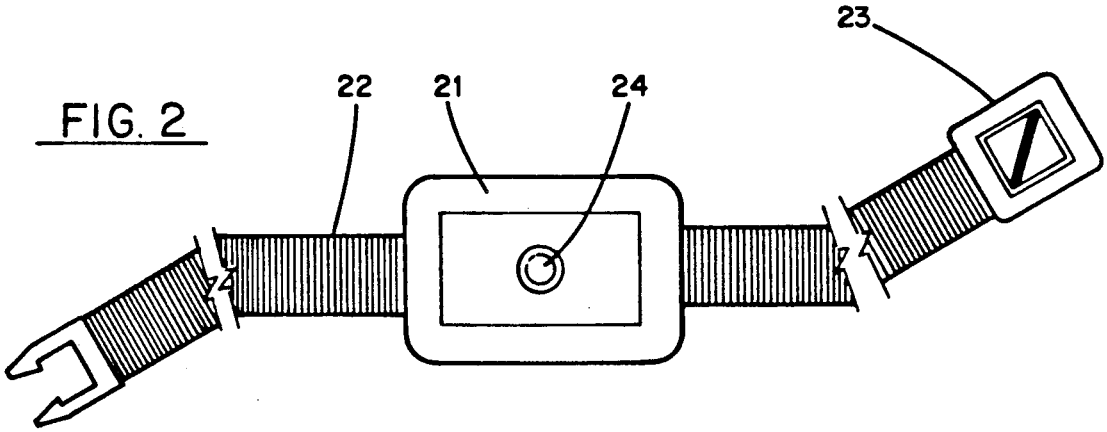
FIG. 2 is a top view of a belt containing an ultrasonic transmitter in accordance with the invention.

In the preferred embodiment, the device is used by a swimmer wearing a battery powered ultrasonic transmitter 24. As shown in FIG. 2, transmitter 24 may be attached to a transmitter housing 21 which may be secured to the swimmer by strap 22 and buckle 23. Transmitter 24 is tuned to the same frequency as receivers 18 and 19, preferably transmits in the frequency range of 20 KHz to 455 KHz, and emits a 4 millisecond pulse every 40 milliseconds. The transmitter is preferably activated by a MOSFET transistor having a gate forward-biased by two terminals exposed to the exterior of the housing so as to be automatically turned on by the change of conductivity when the water is entered, as shown in FIG. *7h*.

Figure 5:
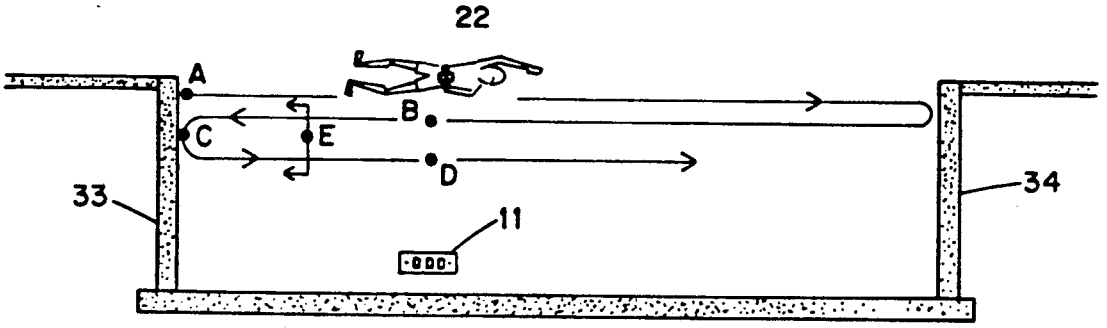
FIG. 5 is a diagrammatic view showing how the invention may be placed in a swim lane and those points along multiple laps when readings are taken to provide the automatic timing correction capability of the invention.

To use the device, the swimmer then places counter housing 11 underwater approximately ten feet from the starting end of the pool lane, as shown in FIG. 5, and activates the device by passing a magnet in proximity to on/off magnetic reed switch 32. The swimmer should stand on the side of the device closest to the starting wall. The device has five operating modes: swim-session, display-data, serial-out, clear-sessions and display temperature. When the device is first turned on, it automatically enters the Swim-session mode. In this mode, the device will sense the pulsing signals from the transmitter worn by the swimmer to determine the direction of the swimmer, and hence, the starting wall. The device will display a series of four dashes in the visual display closest to the swimmer to indicate on which side of the device the starting wall is located. As described below, the swimmer may enter one of the other five modes by actuating the mode select switch as described below. However, assuming another mode is not selected, after about four seconds the top display will display "S-nn" where nn is the current session number about to begin (multiple sets of swim sessions may be stored in the device as described below), the middle display will show a count of 10 and start counting down to 0, and the bottom display (the display closest to the start end) will show all dashes.

If the swimmer wishes to enter a different mode, this may be accomplished by actuating mode select switch 31 until the desired mode is reached. These other modes are indicated by displaying in the middle visual display by the abbreviations SEE (display data mode), PC (serial out mode), CL (Clear-sessions mode), F (display temperature mode), and SESS (swim-session mode, if the swimmer re-enters this mode). Once the desired mode is reached, that mode may be entered by actuating the first magnetic switch 30. For all modes except the display data mode, the user may switch to a different mode be actuating the mode select magnet switch 31 again. To get out of the display data mode, the user must turn off the device by actuating the on-off switch 32, and then turn the device back on by actuating that switch again. Each mode is described in further detail below.

SWIM SESSION MODE

When the swim session mode is selected as noted above, a 10 second countdown begins, which is shown in one of the visual displays in non-inverted format. This period gives the swimmer sufficient time to get out of the pool and prepare to dive in from starting end 33 of the pool lane. Sometime after the ten second period has elapsed, the swimmer dives into the water. Upon entering the water, which will occur at some point between A and B (in FIG. 5) for a jump start, receivers 18 and 19 will detect the signal from transmitter 24, and will start both a time counter and a lap counter. Alternatively, the time counter and lap counter will be started when the device detects forward motion toward the timer, or when the countdown timer reaches zero. However, in many instances, forward motion of the swimmer is not detected immediately, but some time after forward motion actually begins. Therefore, it can be desirable to adjust the timer to account for this time differential. However, the time differential will vary depending on whether the swimmer initially dove into the water, pushed off from the starting wall while in the water, or spent time in the water preparing to start (adjusting swim goggles, for example) before actually pushing off from the starting wall.

Accordingly, in one embodiment of the invention, an adjustment to the starting time is made, depending on the amount of time that elapses between when the time counter starts and when the swimmer first passes over the receivers. Specifically, in the preferred embodiment, two different pass over thresholds are established of 1.5 seconds (the "jump-start" threshold), and 5 seconds (the "valid" start threshold). Thus, the measured time it takes for the swimmer to pass over the receivers may fall into one of three intervals: it may be below the jump-start threshold (a "jump start"), between the jump start and valid start thresholds (a "slow start") or greater than the valid start threshold (an "invalid start"). A predetermined time adjustment is established for each possibility, namely 0.75 seconds is added to the elapsed time for a jump start, 1.5 seconds is added to the elaspsed time for a slow start, and the elapsed time is replaced by a 3 second time count for an invalid start.

A time adjustment is made as follows. If no more time than the jump-start threshold (1.5 seconds) has elapsed when the swimmer passes over the receivers, it is assumed that the swimmer dove into the water and that it took 0.75 seconds from the beginning of the dive for the receivers to detect the swimmer's motion and start the timer. Therefore, 0.75 seconds is added to the time. If from 1.5 to 5 seconds have elapsed by the time the swimmer passes over the receivers, it is assumed that the swimmer pushed off the starting wall and it took one second for the receivers to detect the swimmer's movement. Therefore, one second is added to the elapsed time. Finally, if more than 5 seconds elapse before the swimmer passes over the receivers, it is assumed that the swimmer was adjusting his goggles or otherwise preparing to begin the swim, and that 3 seconds elapsed between the time the swimmer started moving toward the receivers and when the the swimmer passed over the receivers. Therefore the elapsed time is replaced by a second time count.

For each detected start, the lap counter will start at 1 and will be displayed in second display 16. Two types of times will be displayed in the visual displays. The lap time will initially be shown in third display 17, and the total elapsed time will be shown in first visual display 15, as shown in FIG. 4.

Figure 3:
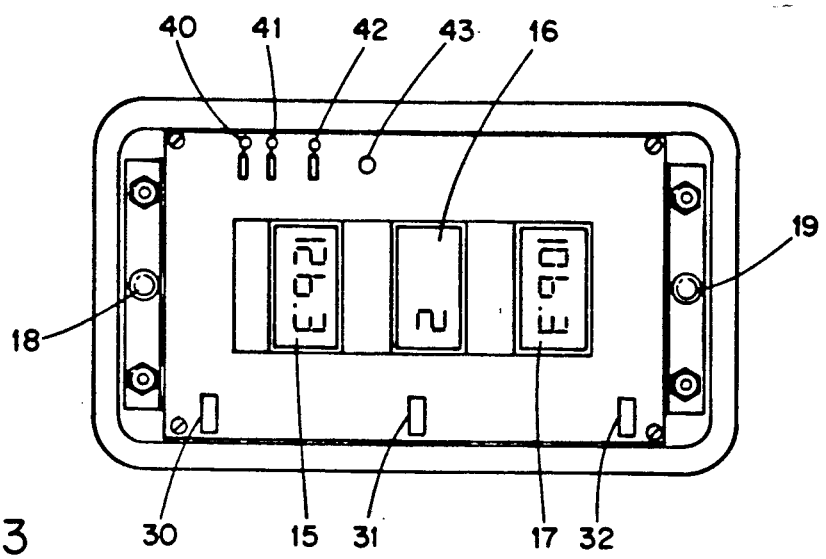
FIG. 3 is a top view of the counter/timer of the invention showing the statistical displays in non-inverted format.
Figure 4:
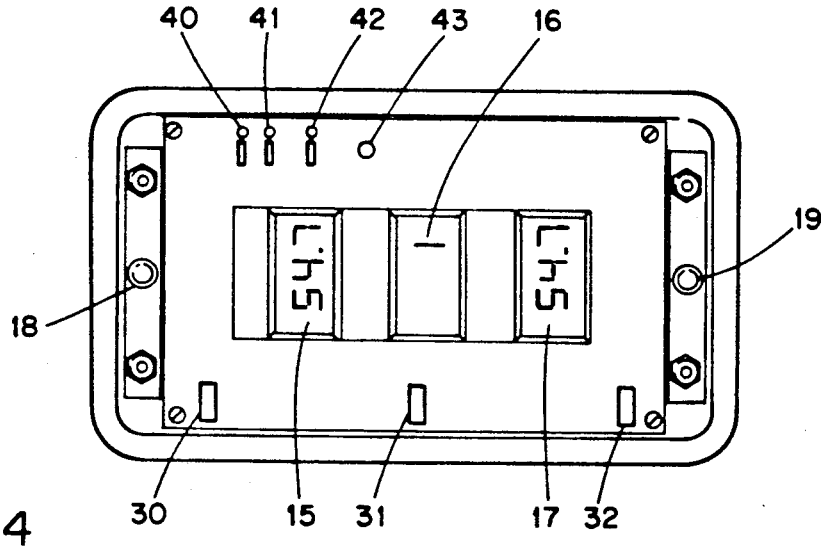
FIG. 4 is a top view of the counter timer of the invention showing the statistical displays in inverted format.

Statistics regarding the swim session are initially displayed in non-inverted format by visual displays 15, 16 and 17 as shown in FIG. 4. Thus, the statistics are readable by the swimmer when the swimmer swims toward the opposite end 34 of the pool lane and looks toward the bottom of the pool. When the swimmer first enters the pool, the signals transmitted by transmitter 24 will reach first receiver 18 before it reaches second receiver 19. As the swimmer swims closer to the device, the time differential between the times the signal reaches the receivers 18 and 19 will decrease. When the swimmer passes over the device, the signal will reach receivers 18 and 19 substantially simultaneously. Approximately 4 seconds after the swimmer passes over the device, the device will invert the statistical displays as shown in FIG. 3. Thus, the displays will be easily readable by the swimmer during the subsequent return portion of the lap. When the displays are inverted, the lap time will be shown in display 15 instead of 17, and the total elapsed time will be shown in display 17 instead of 15. Thus, the lap time will always be the top number, the lap count the middle number and the total time the bottom number.

As the swimmer continues to swim towards opposite wall 34, the signal will reach second receiver 19 before it reaches first receiver 18. This time differential will continue to increase until the swimmer is either out of range of receivers 18 and 19, or until the swimmer reaches opposite end 34 and reverses direction. Thus, when this time differential changes from an increasing amount to a decreasing amount, completion of a half-lap can be detected.

The time differential between receipt of the signal by the receivers will continue to decrease until the swimmer is directly over the device as represented by point B of FIG. 5. At this time, the device will store in memory a reference time constituting the elapsed time at point B. The signal will thereafter be first received by first receiver 18, then, by second receiver 19. When the swimmer reaches starting wall 33 and reverses direction as shown at point C, the time differential between receipt of the signal will again change from increasing to decreasing. This is how the preferred embodiment of the device ordinarily detects completion of a lap. At this point, the lap counter shown in second display 16 will be incremented to show that the swimmer is on the next lap, and the lap time display will be frozen and stored as a third reference count. In addition, the displays will again be inverted so that they may be easily read by the swimmer the next time the swimmer passes over the device. When this occurs as shown by point D in FIG. 5, a fourth reference count is stored. In addition, a lap time verification routine is executed. This routine is executed because the third reference time C can sometimes be suspect due to noise in the signals received by receivers 18 and 19. In this routine, the difference between reference times B and D is computed. One half of this amount is taken and added to reference time B. This total, which is herein referred to as C' will exactly match reference time C if the swimmer took the same amount of time to swim from point B to C as was taken to swim from point C to D. However, this is rarely the case. A time window is computed which consists of the value of C', plus or minus a predetermined percentage of the difference between reference points B and D. In the preferred embodiment, this percentage is twenty five percent and is represent by range E in FIG. 5. If reference time C is within this time window, then it is assumed to be correct. If it is not within this window, then time reference C is replaced by time reference C', and the new value is displayed in the updated lap time visual display. The final lap time is also used to compute the lap time for the following time, and the above procedures are repeated for subsequent laps. Each time a lap is completed, the lap time is stored in computer memory.

In the preferred embodiment, the device detects completion of a swim session when it determines that the swimmer has failed to pass back over the device (point D in FIG. 5). Thus the time used to determine the end of the final lap is when the time differential between receipt of the signal by the receivers either begins to remain constant, begins to decrease, or when the signals are no longer received for a predetermined amount of time, indicating that the swimmer has either exited the pool or turned off the transmitter.

After detecting the end of the swim session, the device stops the time counter and displays the total elapsed time, water temperature (in the display previously used to show the lap number), and the last lap elapsed time. The swimmer can then place the device in any of the other four modes described by actuating mode select switch 31.

DISPLAY-DATA MODE

The Display-Data mode allows the user to view the previously stored data. The user can scan sessions containing lap split times, total elapsed times, and water temperatures. There is a fast and slow scan rate that the user can select. Magnetic switches 30 and 31 serve as scan switches, with switch 31 causing a scan up for a session and switch 30 causing a scan down. Activation of either switch causes the scan rate to be slow initially. However, after approximately two seconds if the switch is still being activated the scan is increased to the fast rate.

SERIAL-OUT MODE

The Serial-Out mode is used to transmit the previously stored data through an interface port, which is comprised of TXD transmit terminal 40, ground terminal 41 and RXD receiver terminal 42, to a user's personal computer by way of an asynchronous RS 232 serial interface. The transmission commences when a serial byte is received from the personal computer and the transmission terminates when all session data has been transmitted.

CLEAR-SESSIONS MODE

The Clear-Sessions mode clears all session data while displaying which sessions are being cleared.

DISPLAY-TEMPERATURE MODE

The Display-Temperature mode converts the frequency produced by the resistance of a thermistor to a frequency converter circuit into a number that represents the water temperature in degrees Fahrenheit or degrees Celsius. The temperature is displayed on the lap display with a degree sign to the right of the units position.

A complete circuit diagram for one embodiment of the present invention is shown in FIGS. 6, 7, and *7a–7h*, and in the appendix. Referring to FIG. 6, the main elements of the device are shown and consist of microcontroller minimum system 51, power control circuit 52, RS-232 interface 53, visual display module 54, temperature module 55, first and second ultrasonic receiver modules 56 and 57, address and control bus 58, and non-volatile RAM module 59. As shown in FIG. 7, the microcontroller minimum system comprises an 80C31 microprocessor 61, an 8282C integrated circuit 62 and a 27C64 integrated circuit 63. Each non-volatile RAM module is comprised of a HM6264LP 8K CMOS RAM from RCA and Dallas Semiconductor lithium battery powered smart socket, as shown in FIG. *7a*.

Referring to FIG. *7b*, the temperature module comprises frequency meter comprised of thermistor RT1, and 0.001 uF timing capacitor C1 coupled to schmidt trigger CMOS digital gates U1A–U1F located on a 4584 integrated circuit chip. FIGS. *7c*, *7d* and *7e* show the three digital display modules. Each liquid crystal display comprises a four digit, seven segment FE202 display driven by a HC0438 driver. Inversion of the displays in accomplished by the software described in the appendix. The ultrasonic receiver circuits are shown in FIGS. *7f* and *7g*, and each comprises a National Semiconductor LM 1812 ultrasonic transducer chip U1 connected to a 40 KHz transducer T1 and tuned by 15.8 mHz adjustable coil L1 and 1 nF capacitor C1. When a pulse of ultrasound is incident on receiving transducer T1, an electrical signal is produced. This electrical signal is amplified and integrated before it is routed to a threshold sensitive detector. The active low output of each detector is connected to one of the two external interrupts of the microcomputer. The transducer that is closest to the source of the emitted ultrasound initiates an interrupt to the microcomputer when the ultrasound is detected. The transducer furthest from the transmitter initiates an interrupt to the microcomputer some time later (sound propagation time differential between receiver). The microcomputer times the interval between the interrupts and identifies which receiver is closest to the ultrasound source.

FIG. *7h* shows the transmitter circuit for the transmitter shown in FIG. 2. The battery powered belt-mounted pulsing signal transmitter is comprised of oscillators, an output driver, some logic, a charging circuit, a water-activated conductivity switch, and a transducer (transmitter). The oscillator used for the transmitted frequency is keyed on and off to produce a repetitious burst of transmitted ultrasound. The frequency of the transmitted signal can range from 20 KHz to 455 KHz depending upon the particular unit. The repetition rate of the transmitted signal can range from 10 HZ to 100 HZ and the duty cycle can range from 5–60% also being particular to the unit.

The system further includes the software shown in the Appendix. A flowchart for the basic software appears in FIG. 8. This software handles the microprocessor interrupts and compares the time differential between received pulsed signals. The software also includes logical timers and counters for tracking total times, lap times and lap counts, and updates each elapsed lap time count upon completion of a lap based upon the time differential between the times the pulsing signal reaches the first and second receivers. In the preferred embodiment of the software, counters are updated when the time differentials between receipt of the pulses by the two receivers change from increasing to decreasing and the swimmer is at the start end. However, the software could be easily modified to update the counter means based on there being substantially no time difference between the times the pulsing signal reaches the first and second receivers, i.e. when a person is directly adjacent to or over the sensor, or based on a change in which receiver receives the signal first. The software also selectively displays the statistics on the visual display in either inverted or non-inverted format.

It will be appreciated to those of skill in the art that numerous changes could be made to the described embodiment of the invention without departing from the spirit or scope of the invention. For example, the disclosed counter/time could easily be used for other types of sporting events, such as runners running laps or vehicles driving laps around a predetermined course. Because each unit can operate within a relatively narrow bandwidth, it is also contemplated that multiple swimmers could use multiple device simultaneously in the same pool, provided that each swimmer uses a device and transmitter tuned to a different frequency. Although the preferred embodiment utilizes two spaced receivers and a pulsing signal to monitor a swimmer, the present invention contemplates that a continuous transmitted signal could be used with single receiver with a doppler shift system to monitor the position and direction of the swimmer. It is also contemplated that the display inversion feature of the present invention could be used with virtually any other type of sensor for detecting the person or object being monitored. For example, inversion of the displays could be triggered by a sensor based on a mechanical switch or breaking a light beam. Moreover, many other varieties of visual displays, including those that are mechanically based or alphanumeric dot array LCD's, could be used instead of the seven segment LCD displays of the preferred embodiment, as long as the visual display is invertible so as to be easily observable by a swimmer swimming in either direction. It is also contemplated that the interface port terminal could be replaced by recently developed magnetically operated transducers or optically operated transducers to provide an interface port in which the components are completely electrically isolated from the exterior of the housing. Also, the magnetically actuated switches on the device could be easily replaced by optical switches or waterproof "feather-touch" switches.

We claim:

1. A timing system for timing a moving object comprising:

a timer capable of storing an elapsed time, means for starting the timer, non-contact detecting means for detecting when the moving object passes by the detecting means, timer adjustment means for automatically adjusting elapsed time stored by the timer based upon the time interval between when the timer starts and when the object passes by the detecting means.

2. The timing system of claim 1 wherein the adjustment means adds a predetermined amount of time to the timer based upon the elapsed time between when the timer starts and when the object passes by the detecting means.

3. The timing system of claim 1 wherein the timing system further comprises:

a waterproof, submersible housing comprising at least one upwardly projecting visual display observable by a downwardly facing swimmer, and an internal power source.

4. The timing system of claim 1 wherein the non-contact detecting means comprises first and second receivers capable of detecting a signal, the receivers being spaced from each other, and comparing means for determining the time differential between the times the signal reaches the first and second receivers.

5. The timing system of claim 1 wherein the timer adjustment means is responsive to at least a first time threshold and a second time threshold, and adjusts the timer means by a different amount based on whether the time interval is below the first time threshold, between the first and second time thresholds, or above the second time threshold.

6. A method of correcting a measured time for a moving object to move past an object detecting means, comprising the steps of:

providing a timer capable of storing an elapsed time, the timer comprising, means for starting the timer, and non-contact detecting means for detecting a moving object passing by the detecting means, starting the timer, determining the time interval between when the timer is started and when the moving object moves past the non-contact detecting means, adjusting the elapsed time stored by the timer by adding a predetermined time count to the elapsed time based upon the time interval.

7. The method of correcting a measured time for a moving object to move past an object detecting means of claim 6, wherein the timer comprises:

a waterproof, submersible housing comprising at least one upwardly projecting visual display observable by a downwardly facing swimmer, and an internal power source.

8. The method of correcting a measured time for a moving object to move past an object detecting means of claim 6, wherein the timer comprises:

first and second receivers capable of detecting a signal, the receivers being spaced from each other, and comparing means for determining the time differential between the times the signal reaches the first and second receivers.

9. The method of correcting a measured time for a moving object to move past an object detecting means of claim 6, further comprising:

providing a first time threshold and a second time threshold, and wherein the time count added to the elapsed time stored by the timer is determined by whether the elapsed time is below the first time threshold, between the first and second time threshold, or above the second time threshold.

10. A method of correcting a measured time for a moving object to move past an object detecting means, comprising the steps of:

providing a timer capable of storing an elapsed time, the timer comprising, means for starting the timer, and non-contact detecting means for detecting a moving object passing by the detecting means, starting the timer, determining the time interval between when the timer is started and when the moving object moves past the non-contact detecting means, adjusting the elapsed time stored by the timer by replacing the time with a predetermined time value based upon the time interval.

11. The method of correcting a measured time for a moving object to move past an object detecting means of claim 10, wherein the timer comprises:

a waterproof, submersible housing comprising at least one upwardly projecting visual display observable by a downwardly facing swimmer, and an internal power source.

12. The method of correcting a measured time for a moving object to move past an object detecting means of claim 10, wherein the timer comprises:

first and second receivers capable of detecting a signal, the receivers being spaced from each other, and comparing means for determining the time differential between the times the signal reaches the first and second receivers.

13. The method of correcting a measured time for a moving object to move past an object detecting means of claim 10, further comprising:

providing a first time threshold and a second time threshold, and wherein the time value used to replace the elapsed time is determined by whether the elapsed time is below the first time threshold, between the first and second time threshold, or above the second time threshold.

* * * * *

UNITED STATES PATENT AND TRADEMARK OFFICE

CERTIFICATE OF CORRECTION

PATENT NO. : 5,130,955

DATED : July 14, 1992

INVENTOR(S) : Dean Lurker, et al

It is certified that error appears in the above-indentified patent and that said Letters Patent is hereby corrected as shown below:

ON THE TITLE PAGE:

Item [76], inventor: "Dean Luerker" should read --Dean Lurker--

Item [19], "Luerker" should read --Lurker--.

Signed and Sealed this

Thirty-first Day of August, 1993

Bruce Lehman

*Attest:*

BRUCE LEHMAN

*Attesting Officer*

*Commissioner of Patents and Trademarks*